US007874341B2

(12) United States Patent
Coleman et al.

(10) Patent No.: US 7,874,341 B2
(45) Date of Patent: Jan. 25, 2011

(54) HINGED CONNECTION, MOVABLE PARTITIONS USING SAME AND RELATED METHODS

(75) Inventors: W. Michael Coleman, Salt Lake City, UT (US); John G. Garrett, Magna, UT (US); Michael D. George, Kaysville, UT (US)

(73) Assignee: Won-Door Corporation, Salt Lake City, UT (US)

( * ) Notice: Subject to any disclaimer, the term of this patent is extended or adjusted under 35 U.S.C. 154(b) by 286 days.

(21) Appl. No.: 11/472,031

(22) Filed: Jun. 21, 2006

(65) Prior Publication Data

US 2007/0294945 A1 Dec. 27, 2007

(51) Int. Cl.
*E05D 15/26* (2006.01)
*E06B 3/48* (2006.01)
*E06B 7/86* (2006.01)

(52) U.S. Cl. ..... 160/199; 160/229.1

(58) Field of Classification Search ..... 160/168.1 V, 160/170.1 V, 199, 229.1, 183, 235, 206, 84.04, 160/89; 16/252, 254, 261, 270, 355, 366, 16/225; 24/563, 555; 411/513, 522
See application file for complete search history.

(56) References Cited

U.S. PATENT DOCUMENTS 2,770,298 A * 11/1956 Hiatt ..... 160/232
3,053,318 A * 9/1962 Artman ..... 160/231.2
3,373,791 A * 3/1968 Milani ..... 160/181
3,481,388 A * 12/1969 Smart ..... 160/84.08
3,670,797 A * 6/1972 Sassano ..... 160/118
3,962,827 A * 6/1976 Chaffee ..... 49/384
4,228,841 A * 10/1980 Dixon ..... 160/183
4,763,712 A 8/1988 van der Klaauw
4,924,932 A * 5/1990 Esnault ..... 160/201
5,411,072 A 5/1995 Starck et al.
6,220,332 B1 * 4/2001 Lai ..... 160/199
6,223,804 B1 5/2001 Toti
6,267,169 B1 7/2001 McDonald
6,546,681 B1 * 4/2003 Trundle ..... 52/202
6,601,637 B2 8/2003 Toti
6,615,894 B1 9/2003 McKeon
6,749,087 B1 * 6/2004 Robinson ..... 222/99
7,516,946 B2 * 4/2009 Fumagalli ..... 256/65.14

* cited by examiner

*Primary Examiner*—Katherine W Mitchell
*Assistant Examiner*—Jeremy C Ramsey
(74) *Attorney, Agent, or Firm*—TraskBritt

(57) ABSTRACT

A movable partition having hinged connections and related methods are disclosed. The partition may include one or more movable structures wherein each movable structure has a plurality of panels and a plurality of hinged structures arranged in an alternating pattern. The panels may include pockets formed along the ends thereof and the hinge structures may include rods formed on the ends thereof. The rods are disposed within the pockets such that a hinged joint is formed. Retainers are removably disposed over a portion of the joint or coupling formed by the rod and associated pocket. The retainer may include a clip having a first member disposed adjacent the pocket, a second member disposed within an interior space of the rod, and a transition member coupling the first and second members and also spanning a portion of the rod and pocket.

16 Claims, 4 Drawing Sheets

HINGED CONNECTION, MOVABLE PARTITIONS USING SAME AND RELATED METHODS

BACKGROUND OF THE INVENTION

1. Field of the Invention

The present invention relates generally to hinged connections and, more particularly, to movable partitions including hinged connections.

2. State of the Art

Movable partitions are utilized in numerous situations and environments for a variety of purposes. Such partitions may include, for example, foldable or collapsible doors configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security and/or fire barrier. In such a case, the door may be configured to automatically close upon the occurrence of a predetermined event such as the actuation of an associated alarm. For example, one or more accordion or similar folding-type door may be used as a security and/or a fire door wherein each door is formed with a plurality of panels hingedly connected to one another. The hinged connection of the panels allows the door to fold up in a compact unit for purposes of storage when not deployed. Thus, the door may be stored, for example, in a pocket formed in the wall of a building when in a retracted or folded state.

When deployment of the door is desired, the door may be manually deployed or it may be driven by a motor along a track, conventionally located above the door in a header, until the door is extended a desired distance across the room to form an appropriate barrier.

Considering the example of a movable partition that includes an accordion-style folding door, such a partition is conventionally constructed with multiple panels which are hingedly coupled to one another in a plicated manner. However, such a structure results in numerous connection points between associated panels and hinge structures. Each such connection point provides a location for potential structural failure of the partition.

For example, when a lateral force or load is applied to such a partition, each connection provides potential location for structural failure to occur within the partition. Such lateral forces or loadings may occur under numerous circumstances including, for example, an individual pushing against a partition while it is in a closed or partially closed position. In another example, where the partition is being used as a fire barrier, a fire often develops winds or drafts that may apply a loading to the partition. Failure of the partition, such as at one of the connection points, in a situation where the partition is intended to be a fire barrier could be disastrous and potentially life threatening.

While it is desirable to provide structurally sound connections between multiple components of a movable partition (e.g., between panels and hinge structures), it is also often desirable to disassemble the various components of a partition for any of a number of purposes. Thus, it may desirable that connections between components of a partition be easily disassembled without any destructive effects to the components themselves such that the components may be reassembled and reused at a later time.

For example, it may be desirable to replace a damaged panel without the necessity of replacing associated hinge components. In another example, where the partition is being used as a fire barrier, the partition may include two laterally spaced sets of plicated panels wherein mechanical and or electrical components are disposed between the two sets of panels. In such a case, it becomes desirable to access the mechanical components and electrical components disposed between such panel sets, from time to time, for maintenance purposes.

It is a continued desire to improve movable partitions so as to increase their reliability. It is also a continued desire to improve movable partitions so as to reduce or simplify maintenance and repair issues that inevitably arise from time to time.

It would, therefore, be advantageous to provide movable partitions having hinged connections that provide ample protection against undesired structural failure while also enabling simple, nondestructive disassembly and reassembly of such components. It would also be advantageous to provide methods of assembling, disassembling and reassembling such partitions having hinged connections.

BRIEF SUMMARY OF THE INVENTION

In accordance with one aspect of the present invention, a movable partition is provided. In one embodiment, the movable partition includes at least one structure having at least one panel, at least one hinge structure and at least one retainer device. The at least one panel includes a pocket formed at an end thereof wherein the pocket defines an opening. The at least one hinge structure includes a rod formed at an end thereof, wherein the rod is at least partially disposed within the pocket. The at least one retainer device includes a first member positioned adjacent a portion of the pocket, a second member disposed within an interior space of the rod and a transition member coupling the first member and the second member and spanning a portion of the pocket and a portion of the rod.

In accordance with another aspect of the present invention, a method is provided for forming a movable partition. The method includes providing a plurality of panels, with each panel having a first end and a second end and also having a pocket formed at each of the first end and the second. A plurality of hinge structures are provided wherein each hinge structure includes a first end and a second end and wherein each hinge structure further includes a rod formed at each of the first end and the second end of the hinge structure. The plurality of panels and the plurality of hinge structures are coupled such that one rod of each hinge structure is disposed within one pocket of an adjacent panel. A retainer is removably coupled with a portion of each rod and its associated pocket such that a first member of the retainer is adjacent the associated pocket, a second member of the retainer is disposed within an interior space of the associated rod, and a third member of the retainer is coupled to the first member and the second member.

Other structures and methods will be readily apparent upon reading the detailed description. For example, the present invention further provides a method of assembling and disassembling movable partitions in a nondestructive fashion.

Similarly, the present method provides methods for repair and maintenance of movable partitions.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1A:
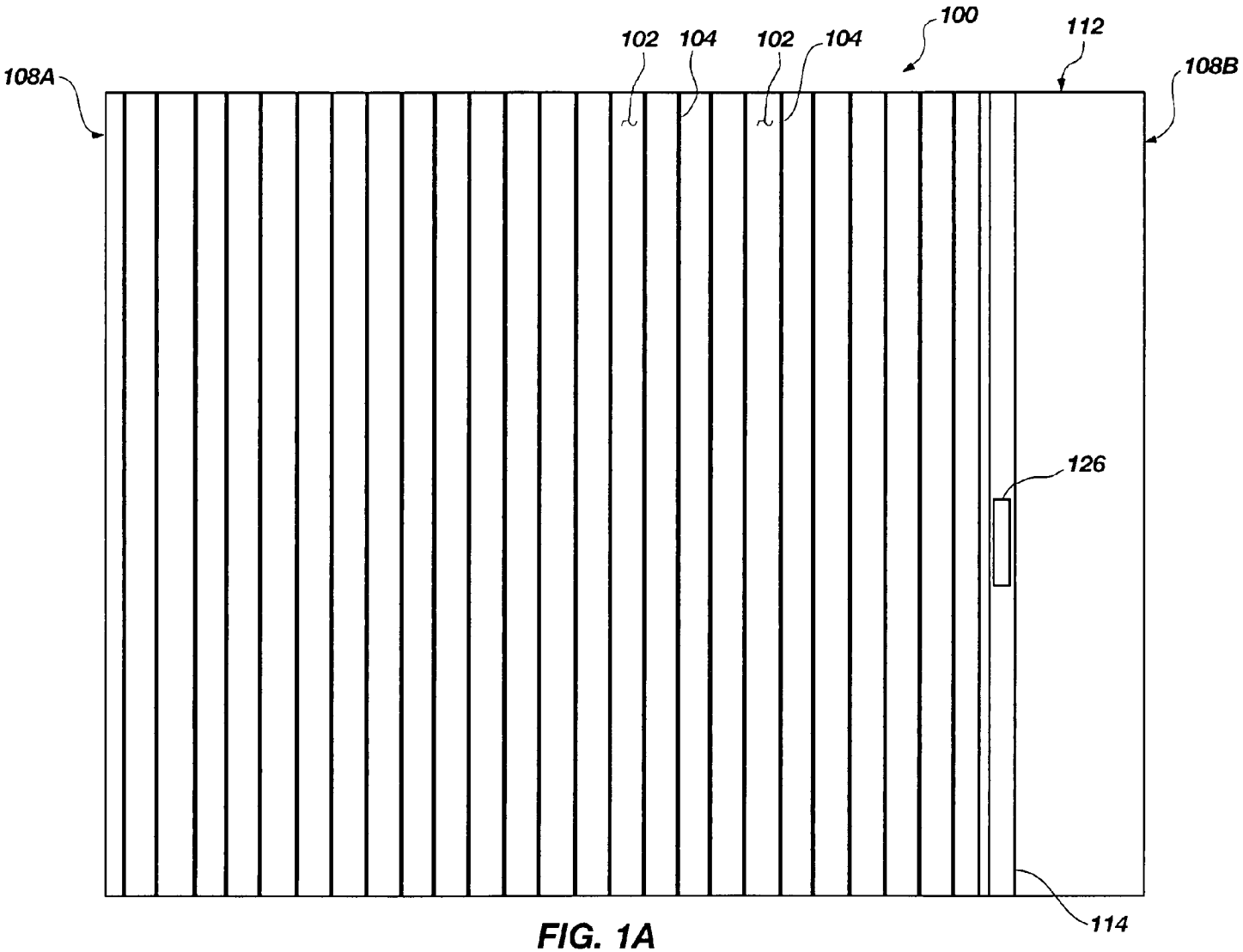
FIGS. 1A and 1B are elevation and plan views, respectively, of a movable partition in accordance with one embodiment of the present invention.
Figure 1B:
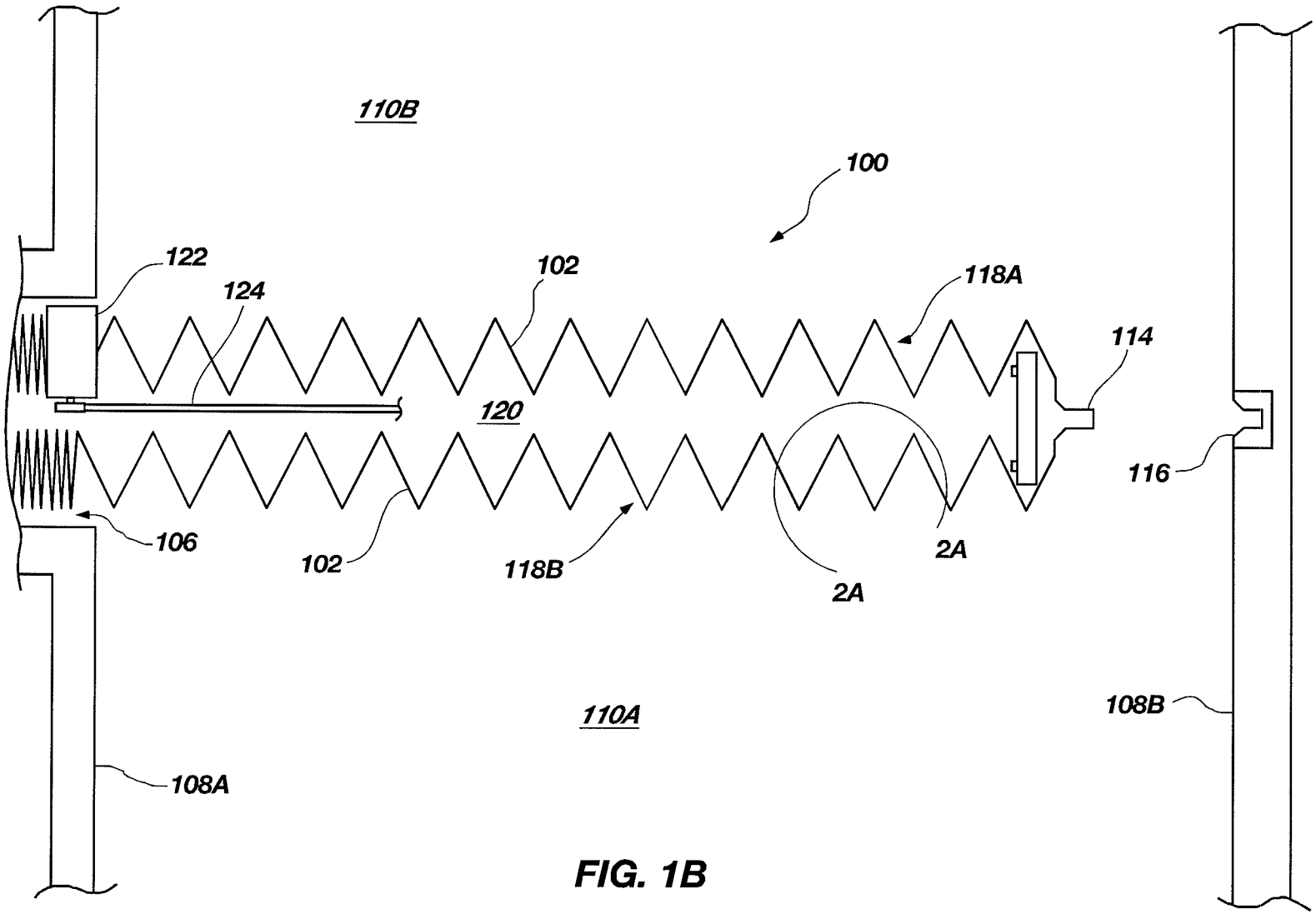

Referring to FIGS. 1A and 1B, an elevation view and a plan view of a movable partition 100 are shown. In the example shown in FIGS. 1A and 1B, the partition 100 may be in the form of a folding door. The partition 100 may be used, for example, as a security door, a fire door or as both. In other embodiments, the partition need not be utilized as a fire or security door, but may be used simply for the subdividing of a larger space into smaller rooms or areas. The partition 100 may be formed with a plurality of panels 102 that are connected to one another with hinges or other hinge-like structures 104 in an alternating pattern of panel 102/hinge structure 104. The hinged connection of the individual panels 102 enables the panels to fold relative to each other in an accordion or a plicated manner such that the partition 100 may be compactly stored in a pocket 106 formed in a wall 108A of a building when in a retracted or folded state.

When in a deployed state, the partition 100 may extend from one wall 108A to a second wall 108B to act as a barrier (e.g., a fire or security barrier) or to divide one area or room into multiple rooms 110A and 110B. When it is desired to deploy the partition 100 from a stowed condition to an extended position, for example, to secure an area during a fire, the partition 100 may be motivated along a track 112 across the space to provide an appropriate barrier. When in a deployed or an extended state, a leading edge of the partition 100, shown as a male lead post 114, may complementarily or matingly engage with a jamb or door post 116 that may be formed in a wall 108B of a building. As can be seen in FIG. 1B, the partition 100 may include a first barrier or structure 118A and a second barrier or structure 118B, each including a plurality of panels 102 and coupled with one another by way of hinges or hinge-like structures 104. The second structure 118B is laterally spaced from the first structure 118A. Such a configuration may be utilized as a fire door wherein one structure 118A acts as a primary fire and smoke barrier, the space 120 between the two structures 118A and 118B acts as an insulator or a buffer zone, and the second structures 118B acts as a secondary fire and smoke barrier. Such a configuration may also be useful in providing an acoustical barrier when the partition is used to subdivide a larger space into multiple, smaller rooms.

Various means may be used to displace the partition 100 from a stowed condition to a deployed condition and vice versa. For example, depending on the intended use of the partition 100, it may be displaced manually (i.e., an individual pulling it across the track 112). In another embodiment, an appropriate mechanical actuator may be used to displace the partition 100. For example, a drive, which may include, for example, a motor 122 and a drive belt or chain 124 (FIG. 1B), may be configured to open and close the partition upon actuation thereof. Additionally, while not specifically shown, various sensors and switches may be employed in association with such a drive to assist in the control of the partition 100. For example, as shown in FIG. 1A, when used as a fire door, the partition 100 may include a switch or actuator 126, commonly referred to as "panic hardware." Actuation of the panic hardware 126 allows a person located on one side of the partition 100 (e.g., in room 110A) to cause the partition 100 to open if it is closed, or to stop while it is closing, so as to provide access through the barrier formed by the partition 100 for a predetermined amount of time.

It is noted that, while the exemplary embodiment shown and described with respect to FIGS. 1A and 1B is directed to a single partition 100 extending from one wall 108A to another wall 108B, other movable partitions may be utilized. For example, a two-door, or bi-part partition configuration may be utilized wherein two similarly configured partitions extend across a space and join together to form an appropriate barrier as will be appreciated by those of ordinary skill in the art.

Figure 2A:
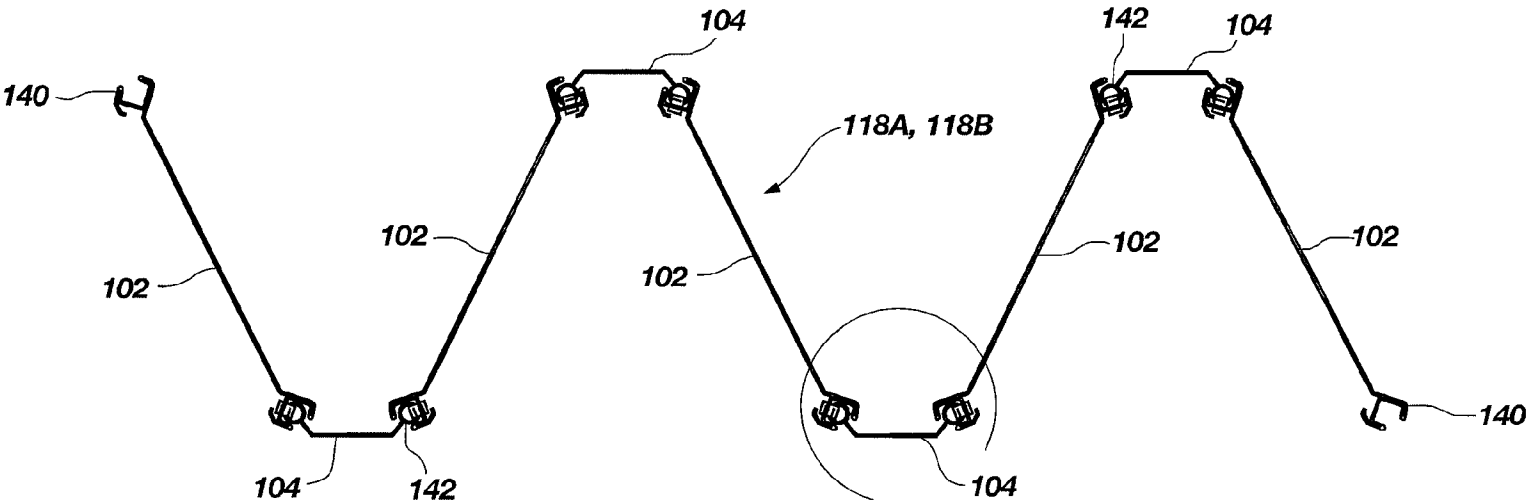
FIG. 2A is an enlarged detail view of a portion of a movable partition as indicated in FIG. 1B.

Referring now to FIG. 2A, a detail, as indicated in FIG. 1B, shows the construction of a partition 100, including the hinged connection of panels 102, in accordance with an embodiment of the present invention. As previously stated, a plurality of panels 102 is coupled to each other by way of hinge components or structures 104. The panels 102 may include, for example, a portion formed on an end thereof as a pocket 140 for receipt of a corresponding end of the hinge structure 104 formed generally as a cylinder or a rod 142.

Figure 2B:
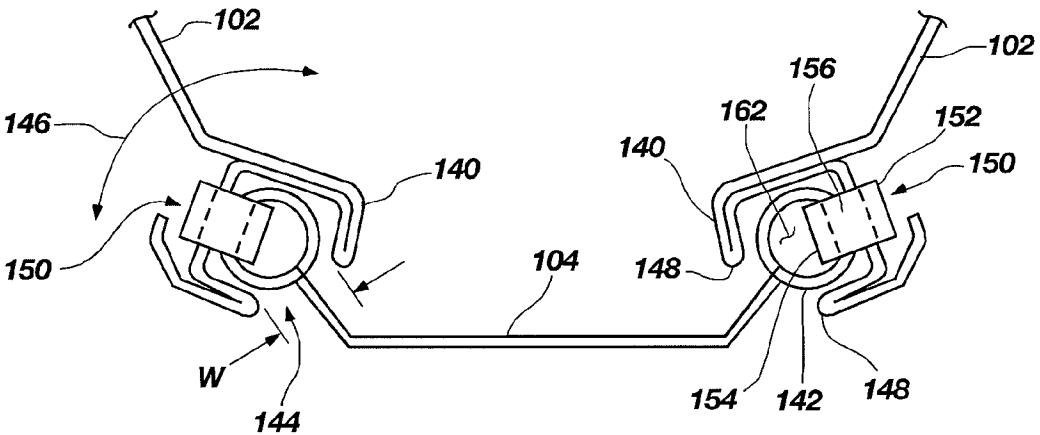
FIG. 2B is an enlarged detail view of a hinged connection, as indicated in FIG. 2A, in accordance with an embodiment of the present invention.

FIG. 2B shows a further enlarged portion of the connection of panels 102 with a hinge structure 104. The pocket 140 is configured to define an opening or a mouth 144 through which the rod 142 of the hinge structure 104 is received during assembly of the two components. It is noted that, in one embodiment, the width W of the opening 144 is smaller than a diameter or cross-sectional width of the rod 142. Thus, with regard to such an embodiment, the pocket is elastically deformed to force the rod 142 through the opening 144 defined by the pocket 140 during assembly or disassembly of a panel 102 and a hinge structure 104.

When assembled, the panels 102 are able to rotate relative to the hinge structure 104 such as is indicated by directional arrow 146. The ends 148 of the pocket 140 serve to define the opening 144 and may be configured to either limit or permit a desired degree of rotation of the panel 102 with respect to the hinge structure 104. For example, the degree of relative rotation may be limited when one of the ends 148 abuts a wall or other component of the hinge structure 104.

In addition to the rod 142 being retained within the pocket 140 by virtue of the interference between the rod 142 and the opening 144, a retainer 150 may be coupled to a portion of the pocket 140 and a portion of the rod 142. The inclusion of a retainer 150 ensures that the connection between a panel 102 and a hinge structure 104 is maintained even in the event of an inadvertent lateral force being applied to the partition 100 (or to a portion thereof) that would otherwise be of such magnitude to elastically deform the pocket 140 and allow the rod 142 to be released therefrom. Such a retainer 150 may be removably installed on the connection between the panel 102 and the hinge structure 104 such that disassembly of the components may be easily achieved for maintenance and repair purposes.

Figure 3A:
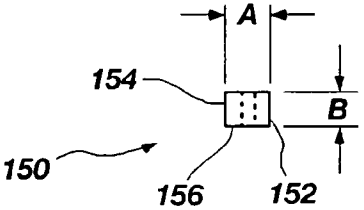
FIGS. 3A and 3B are plan and side elevation views, respectively, of a component used in association with the hinged connection of FIG. 2B in accordance with an embodiment of the present invention.
Figure 3B:
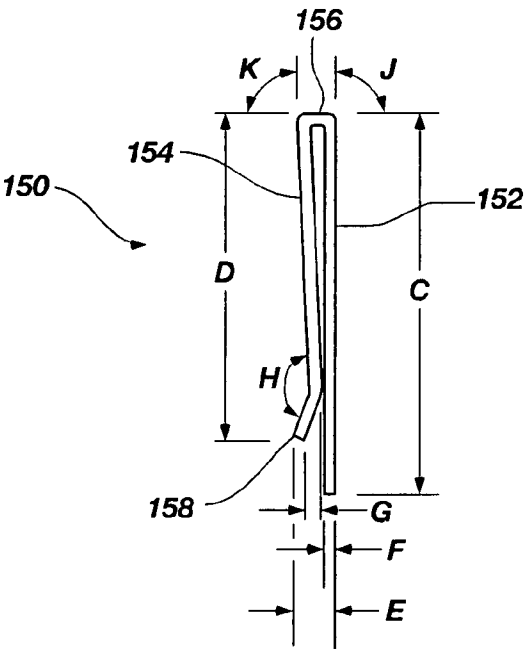

Referring to FIGS. 3A and 3B, plan and elevation views are shown, respectively, of one example of a retainer 150 that may be used in an embodiment of the present invention. The retainer may be in the form of a clip having a first member 152 coupled with a second member 154 by way of a transition member 156. The second member 154 may extend at an angle relative to the first member 152 such that it effectively provides a pinching action against the first member 152. The second member 154 may also include a lip portion 158 that extends back away from the first member (as shown in FIG. 3B) such that, during installation of the retainer 150, a component or structure may be easily inserted between the first member 152 and the second member 154. The retainer 150 may be formed, for example, that when installed, the second member 154 becomes displaced laterally from the first member 152 while maintaining a bias or a spring force in the direction of the first member 152.

In one specific embodiment, described by way of example only, the retainer may be configured with the following dimensions (with reference to the dimension identifiers shown in FIGS. 3A and 3B): "A" (a length of the transition member 156) is approximately 0.195 inches; "B" (a width of the retainer 150) is approximately 0.15 inches; "C" (a height of the first member 152) is approximately 1.65 inches; "D" (a height of the second member) is approximately 1.43 inches; "E" (a distance from the back of the first member 152 to the edge of the lip portion 158) is approximately 0.2 inches; "F" (thickness of the material forming the retainer 150) is approximately 0.06 inches; "G" (A distance from the back edge of the second member 154 where it is most proximate the first member 152 to the outer edge of the lip portion 158) is approximately 0.07 inches; "H" (the angle defined between the main portion of the second member 154 and the lip portion 158) is approximately 158°; "J" (the angle defined between the first member 152 and the transition member 156) is approximately 90°; and "K" (the angle defined between the second member 154 and the transition member 156) is approximately 87°.

In one embodiment, the retainer 150 may be formed as a unitary structure formed from a common, homogenous material. For example, the retainer may be formed from a rectangular sheet of stock steel which is bent into the desired configuration. In other embodiments, the retainer may be formed from casting, molding or other manufacturing processes and may be formed from various materials including various metals, metal alloys and plastics.

Figure 4:
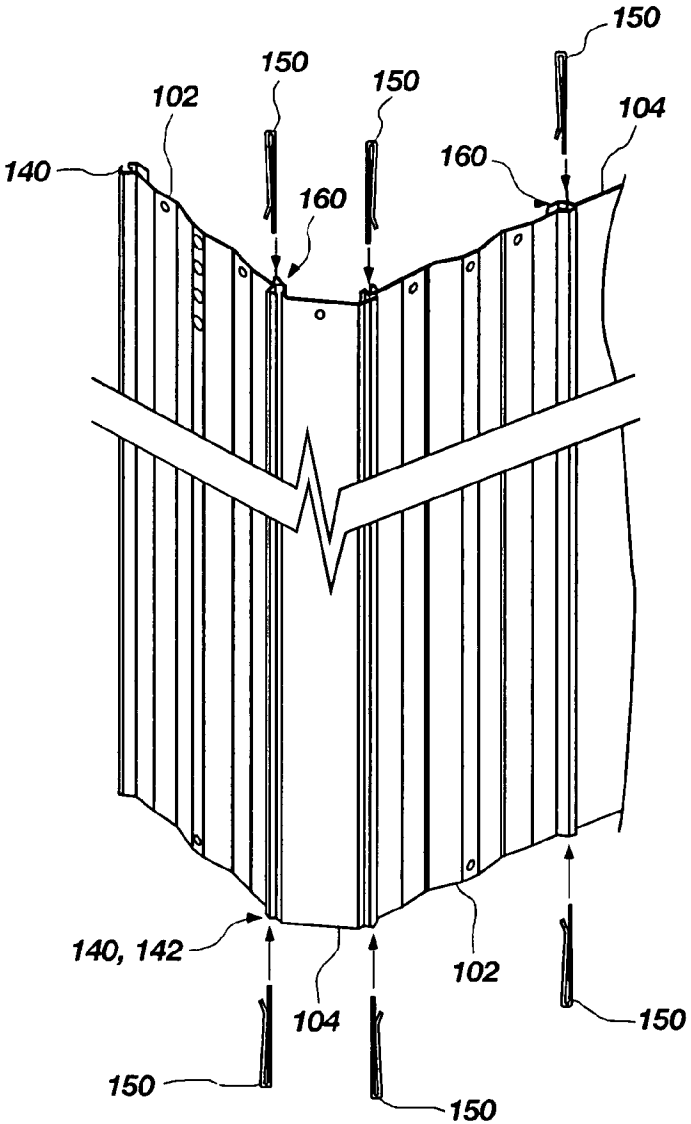
FIG. 4 is partially exploded perspective view of a movable partition in accordance with an embodiment of the present invention.

Referring now to FIG. 4 in conjunction with FIG. 2B, the installation of retainers 150 is illustrated. As previously discussed, one or more panels 102 may be coupled with one or more hinge structures 104 such as through an interfering geometrical configuration. The retainer 150 may be slid over the ends 160 of the panel 102/hinge structure 104 connections such that, for example, the first member 152 of the retainer is adjacent to and contiguous with a portion of the pocket 140, the second member 154 is disposed within a central opening 162 defined by the rod 142, and the transition member 156 of the retainer 150 spans across portions of both the pocket 140 and the rod 142. Of course the retainer could be reversed such that positions of the first and second members 152 and 154 are switched with one another.

As already noted, the retainer 150 maintains the connection between the pocket 140 of the panel 102 and the rod 142 of the hinge structure 104 such that the two components are not inadvertently pulled apart when the panels 102 are over-rotated or subjected to an undesirable lateral force. However, the retainers 150 are configured to still permit proper rotation between the panels 102 and the hinge structures 104 such that the partition 100 (FIGS. 1A and 1B) may be deployed and retracted in accordance with their design and purpose.

Referring to FIG. 4 in conjunction with FIG. 1B, if a partition 100 ever required maintenance or repair, or if access was desired to the space 120 between the two structures 118A and 118B, the retainers 150 could be easily removed by pulling them from the connection between the panels 102 and the hinge structure 104. Thus, the removable nature of the retainers 150 provides additional structural integrity of the partition 100 while also enabling simple, nondestructive disassembly and reassembly of panels 102 and hinge structures 104.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A movable partition, comprising: at least one structure comprising:

at least one panel having a pocket formed at an end thereof, the pocket comprising an elastic material and defining an opening;

at least one hinge structure having a rod formed at an end thereof, wherein the rod is at least partially disposed within the pocket by an elastic deformation of the pocket and configured to rotate within the pocket when disposed therein; and at least one retainer device configured as a unitary member, the retainer device having a first member positioned adjacent a portion of the pocket, a second member including a main portion biased toward the first member and disposed within an interior space of the rod and a transition member coupling the first member and the second member and spanning a portion of the pocket and a portion of the rod such that the at least one retainer clip laterally secures the rod in the pocket while also allowing rotation of the pocket relative to the rod;

wherein the at least one panel is rotatable relative to the hinge structure.

2. The movable partition of claim 1, wherein the at least one panel comprises a plurality of panels, the at least one hinge structure comprises a plurality of hinge structures and the at least one retainer comprises a plurality of retainers and wherein the plurality of panels and the plurality of hinge structures are arranged in an alternating pattern such that at least one hinge component is disposed between and coupled with each two adjacent panels of the plurality of panels.

3. The movable partition of claim 2, wherein the at least one structure includes two structures laterally spaced from one another.

4. The movable partition of claim 1, wherein the second member of the at least one retainer includes a lip portion extending away from the first member.

5. The movable partition of claim 4, wherein an angle between the main portion of the second member and the lip portion of the second member defines an angle of approximately 158°.

6. The movable partition of claim 1, wherein the first member and the transition member define an angle of approximately 90°.

7. The movable partition of claim 6, wherein the second member and the transition member define an angle of approximately 87°.

8. The movable partition of claim 1, wherein the retainer is formed from a material comprising steel.

9. The movable partition of claim 1, wherein a diameter of the rod is greater than a width of the opening of the pocket.

10. A method of forming a movable partition, the method comprising:

providing a plurality of panels, each panel having a first end and a second end and having a pocket formed at each of the first end and the second end, the pocket comprising an elastic material;

providing a plurality of hinge structures, each hinge structure having a first end and a second end and having a rod formed at each of the first end and the second end of the hinge structure;

rotatably coupling the plurality of panels relative to the plurality of hinge structures such that one rod of each hinge structure is disposed within one pocket of an adjacent panel by elastic deformation of the one pocket and configured to rotate within the one pocket when disposed therein;

removably coupling a retainer with a portion of each rod and associated pocket such that a first member of the retainer is adjacent the associated pocket, a second member of the retainer is disposed within an interior space of the associated rod and a third member of the retainer is coupled to the first member and the second member;

forming the retainer as a unitary structure such that the retainer laterally secures the associated rod in the associated pocket while also allowing rotation of the associated pocket relative to the associated rod; and configuring the retainer such that the second member is biased toward the first member.

11. The method according to claim 10, further comprising defining an opening in each of the pockets and configuring each rod to exhibit a diameter that is greater than a width of its associated pocket opening.

12. The method according to claim 10, further comprising forming the retainer by providing a sheet of metal and bending the sheet of metal into a desired configuration.

13. The method according to claim 10, further comprising forming the first member and the third member to define an angle of approximately 90° therebetween.

14. The method according to claim 13, further comprising forming the second member and the third member to define an angle of approximately 87° therebetween.

15. The method according to claim 13, further comprising forming the second member to include a main portion and a lip portion, wherein the main portion extends away from the first member.

16. The method according to claim 15, wherein the main portion and the third member define an angle of approximately 87° therebetween and wherein the main portion and the lip portion define an angle of approximately 158° therebetween.

* * * * *

UNITED STATES PATENT AND TRADEMARK OFFICE

CERTIFICATE OF CORRECTION

PATENT NO. : 7,874,341 B2
APPLICATION NO. : 11/472031
DATED : January 25, 2011
INVENTOR(S) : Coleman et al.

It is certified that error appears in the above-identified patent and that said Letters Patent is hereby corrected as shown below:

In the specification:

COLUMN 2, LINE 49, change "second." to --second end.--
COLUMN 2, LINE 50, change "are" to --is--

Signed and Sealed this
Tenth Day of December, 2013

Margaret A. Focarino

Margaret A. Focarino
*Commissioner for Patents of the United States Patent and Trademark Office*